US005376030A

United States Patent [19]

Brewbaker, III

[11] Patent Number: 5,376,030

[45] Date of Patent: Dec. 27, 1994

[54] OUTBOARD MOTOR MOUNTING APPARATUS VERTICAL MOVEMENT DEVICE

[76] Inventor: John J. Brewbaker, III, 3721 Sandpiper La., Chesapeake, Va. 23325

[21] Appl. No.: 215,943

[22] Filed: Mar. 21, 1994

[51] Int. Cl.[5] ..... B63H 5/12

[52] U.S. Cl. ..... 440/61; 440/62

[58] Field of Search ..... 440/60, 61, 63; 248/641-643

[56] References Cited

U.S. PATENT DOCUMENTS

| | | | |
|---|---|---|---|
| 2,716,960 | 9/1955 | McCumber | 440/62 |
| 4,391,502 | 7/1983 | Hundertmark | 440/61 |
| 4,482,330 | 11/1984 | Cook | 440/61 |
| 4,624,438 | 11/1986 | Goodman | 440/61 |
| 4,889,507 | 12/1989 | Tahara et al. | 440/61 |
| 4,950,189 | 8/1990 | Tahara et al. | 440/61 |

*Primary Examiner*—Jesus D. Sotelo

[57] ABSTRACT

The invention provides for vertical motion of an outboard motor on an outboard motor mounting apparatus by utilizing the angular motion of the outboard motor's tilt and trim feature to achieve the lift. The preferred embodiment of the invention achieves this motion through the use of a cable and pulley system.

1 Claim, 3 Drawing Sheets

OUTBOARD MOTOR MOUNTING APPARATUS VERTICAL MOVEMENT DEVICE

BACKGROUND OF THE INVENTION

1. Field of the Invention

This invention relates in general to an apparatus for mounting an outboard motor on the transom of a boat so that the motor can be raised and lowered relative to the transom. More specifically, the present invention utilizes angular motion from the outboard motor's tilt and trim apparatus to obtain the desired movement.

2. Prior Art

For maximum efficiency of operation, an outboard motor should be mounted on the transom of a boat such that the cavitation plate of the motor runs across the water surface once the boat has reached a planing condition. Depending on variables such as boat size, weight, load, hull configuration, and horsepower, it is desirable to have the capability to raise and lower the motor vertically as conditions dictate to achieve maximum thrust, maximum speed, minimum drag, and/or maximum fuel economy. Outboard motor manufacturers have attempted to increase the versatility of their motors by offering a motor tilt and trim apparatus that provides for angular movement of the motor, and therefore the propeller relative to the transom bracket that secures the motor to the transom. A typical hydraulic tilt-trim system is described in Hundertmark U.S. Pat. No. 4,391,592. The trim portion of the movement in general provides 15 degree of movement and is functional when the boat is operating at any speed or load. The tilt feature of the movement extends generally 40–60 degrees past the trim range and is functional only at slow speed, low load, and when the motor is not running. The tilt function is primarily intended for beaching of the boat, operating at slow speeds in shallow water, and raising the motor out of the water for trailering and when the boat is otherwise not in use.

A typical outboard motor mounting apparatus of Cook U.S. Pat. No. 4,482,330 provides for mounting the outboard motor on the transom of a boat so that the motor can be raised and lowered on the transom. One version of the apparatus utilizes an electric pump and hydraulic cylinder to obtain the force necessary to move the motor vertically. In combination with the outboard motor's tilt and trim features, many combinations of vertical and angular positioning of the outboard motor are possible to allow; the operator a variety of choices of motor trim/tilt, and vertical motor positioning, as conditions and objective warrant. The outboard mounting apparatus of Cook U.S. Pat. No. 4,482,330 is equipped with a transom bracket and motor bracket. The hydraulic action results in movement of the motor bracket relative to the transom bracket thereby providing the means for the vertical movement of the motor relative to the transom. The force required for this movement is provided by a hydraulic actuating cylinder and reversible hydraulic pump driven by an electric motor through a switching circuit powered by the motor's automotive type battery. Needless to say, the motive force required to operate the system entails expense, added weight, complexity, and additional electrical draw from the battery. These factors make the system less desirable to the average outboard motor boat owner.

Similar systems are being produced that provide for adjustment of the motor bracket manually. Typically, this entails a set-up similar to the system previously described however the activating cylinder, hydraulic pump, electric motor, and switching circuit are eliminated. The motive force is generally provided by a manually operated threaded bolt adjusting mechanism. Advantages of this system include: A substantial cost savings over the hydraulic system, a less complex system and therefore less likelihood for failure, less weight, and no current draw from the electrical system. Disadvantages of these systems include: less flexibility in the motor positioning since no adjustment can be made while the boat is underway, and less convenience in changing the motor position since the changes are made manually. Generally, the adjustment must be made from a position outside of the boat. An adjustable outboard transom device exists that enables the operator to adjust the motor vertically on a typical transom jack from inside the boat with more rapid height adjustments than is possible with the conventional threaded bolt adjusting mechanisms. This is detailed in Goodman U.S. Pat. No. 4,624,438. This device however requires manual mechanical input from the operator and cannot feasibly be operated while the boat is being operated.

No device is known, however, that combines the cost savings, weight reduction, and simplicity of the manual outboard motor mounting apparatus with additional attributes of the hydraulic outboard motor mounting apparatus.

SUMMARY OF THE INVENTION

The principal object of the present invention is to provide a device that will increase the versatility of the manual outboard motor mounting apparatus for a minimal expense over the cost of the manual outboard motor mounting apparatus alone.

It is also the object of the present invention to provide a simple means for adjusting the motor to a fixed position utilizing the mechanical advantage of the motor's tilt/trim feature. The present invention utilizes the angular motion of the motor's tilt/trim mechanism to provide the motive force to raise and lower the motor bracket portion of the outboard motor mounting apparatus. The vertical lift of the motor bracket is therefore proportional to the angular position of the motor.

In general outboard motor operation, the motor is set in the down, or "Tucked In" position prior to planing the boat such that the boat will achieve a plane quicker and without undesirable bow lift. As speeds increase, the trim is generally positioned outward to decrease drag, increase speed, and save fuel. Similarly, the hydraulic outboard motor mounting apparatus compliments the tilt/trim feature of the outboard by moving the motor upward in a more efficient and effective vertical plane. When used in combination, the boat operator can attain maximum power, fuel economy, speed, and handling characteristics. In most circumstances as described above the motor's trim feature and hydraulic outboard mounting apparatus are operated in an upward direction to achieve the desired results. For example, when the motor is being trimmed up to decrease drag, it is also being lifted vertically by the outboard motor mounting apparatus to compound the results. The same is true in the opposite direction. Because of the similarity of purposefulness, the present invention is useful in that it provides vertical movement of the motor by the outboard motor mounting apparatus whenever the motor's tilt/trim feature is used. An additional desirable feature of the present invention is that at maximum tilt of the motor the outboard motor mounting apparatus will be positioned vertically at its maximum lift to keep the motor's lower unit out of the water during periods of inactivity, thereby decreasing the harmful effects of prolonged submersion of the motor in the water.

DETAILED DESCRIPTION

Figure 1:
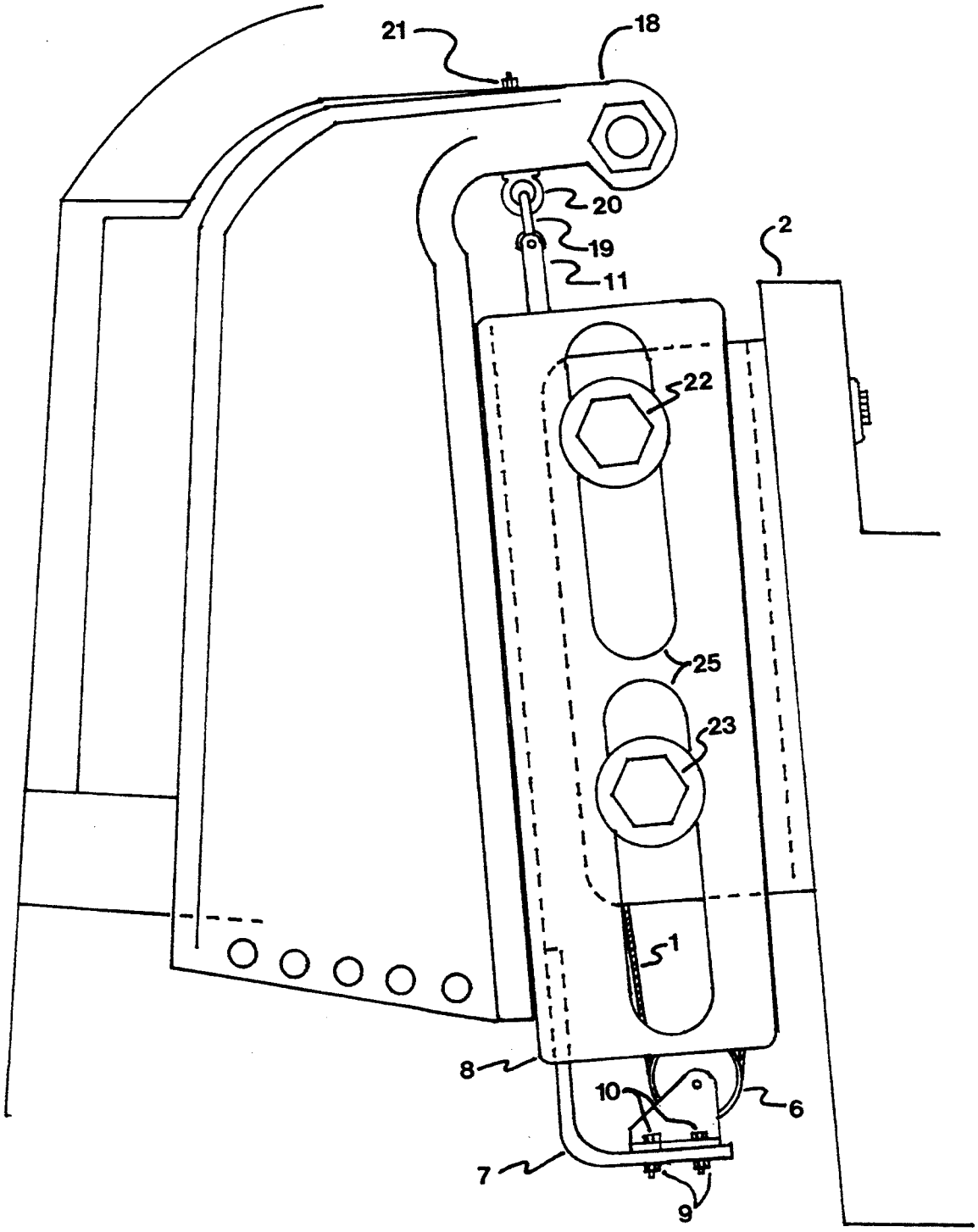
FIG. 1 is a side elevation of an outboard motor mounting apparatus vertical movement device incorporated into an existing outboard motor mounting apparatus.
Figure 2:
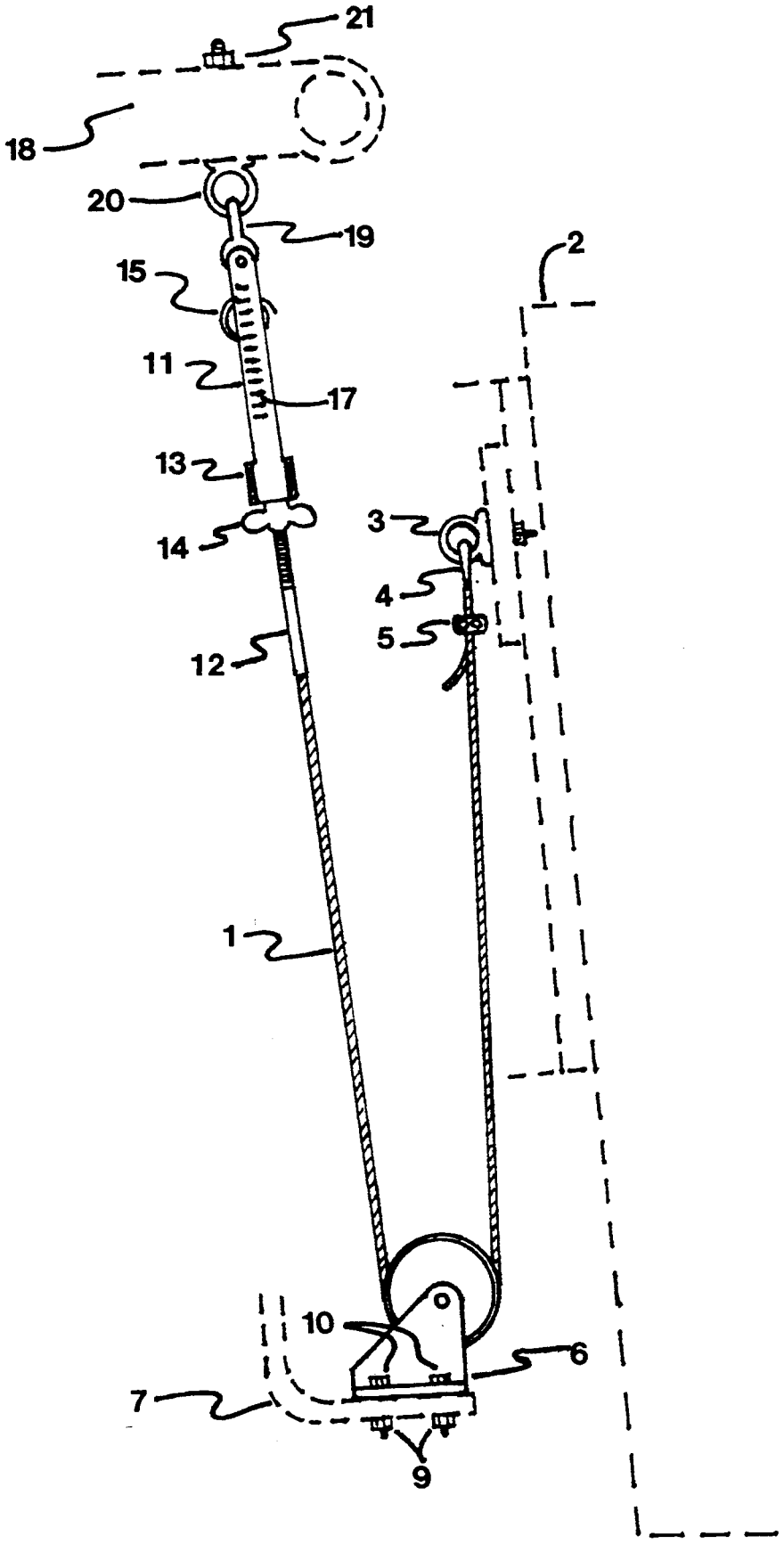
FIG. 2 is a fragmentary, side perspective of the primary elements utilized in the device.
Figure 3:
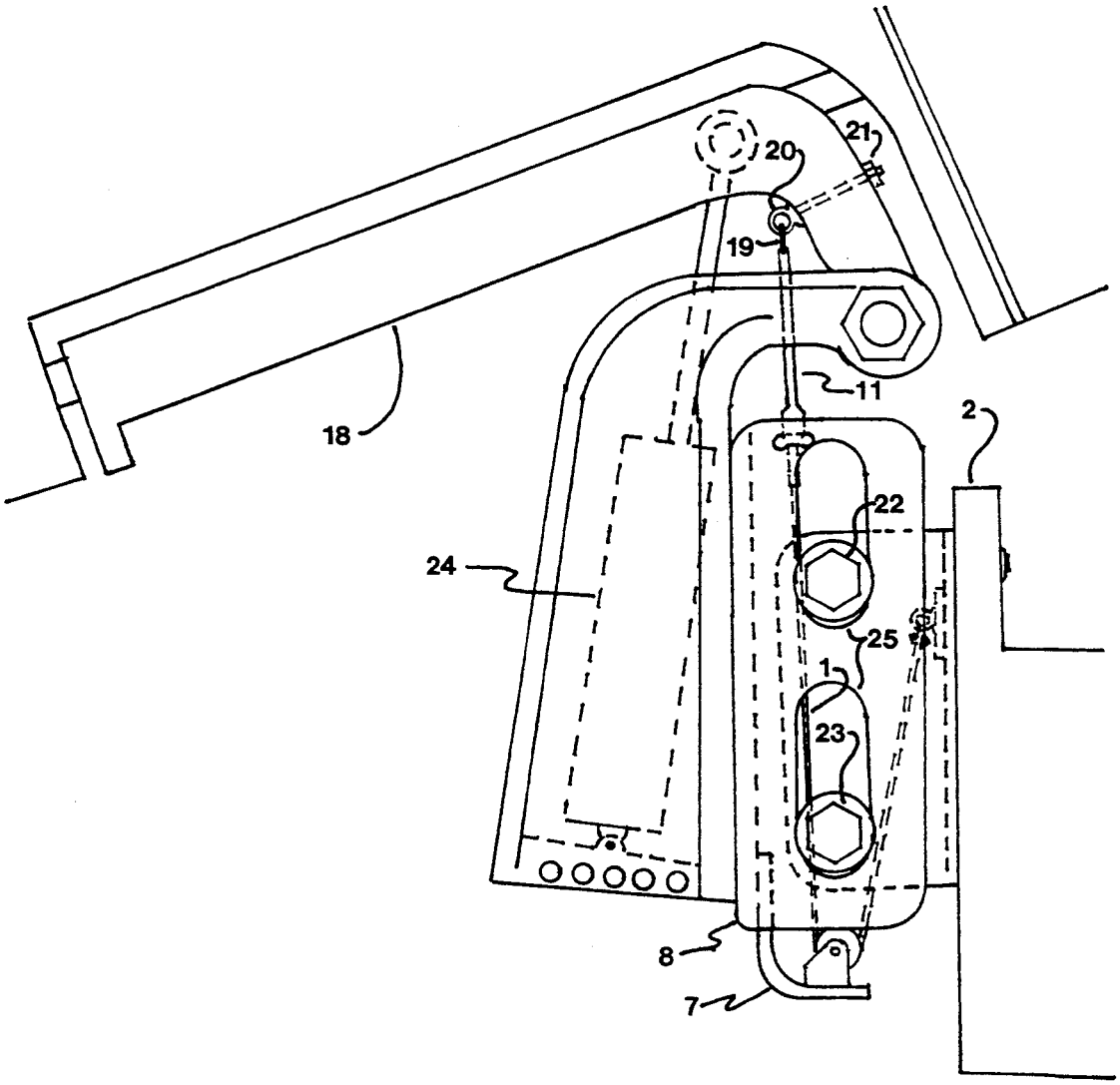
FIG. 3 is a side elevation of an outboard motor mounting apparatus vertical movement device shown with the motor's integral tilt/trim cylinder. This figure shows the motor in its fully tilted and lifted configuration.

As shown in the drawings, the outboard motor mounting apparatus vertical movement device includes a cable 1 which preferable is of stainless steel. The cable is attached to the boat transom 2 or any fixed component thereof by preferably passing through an eyebolt 3. A thimble 4 or similar device prevents chafing. Recommended means of securing cable to this fixed position is by means of a cable clamp 5. Eyebolt, thimble, and cable clamp are likewise recommended to be made of stainless steel to resist corrosion. A pulley type fixture 6 suitably sized to cable size and anticipated motor load and other associated forces is attached to cross angle member 7. It shall be noted that cross angle member is attached to motor bracket 8 as discussed in prior art. Angle member 7 is attached to motor bracket 8. Pulley type fixture 6 is attached to said cross angle member 7 by use of appropriate number and size nuts 9 and bolts 10. Remaining end of cable is attached to a turnbuckle type fixture 11. The turnbuckle 11 is optional, however is recommended for maximum versatility. Method of attachment to cable 1 is best accomplished using a compression type attachment at 12. Adjusting knob 13 allows for a variable range of motion at the operator's discretion. A locking nut 14 is provided to ensure the preset adjustment does not change as a result of adjusting knob 13 rotation from motor vibrations. A spring clip 15 should be inserted through a hole in the end of the threaded portion 16 of the turnbuckle 11 to prevent rotation of the threaded portion 16 of the turnbuckle when it is adjusted. Markings 17 on turnbuckle provide for a convenient point of reference to assist the operator when making adjustments. The upper portion of the turnbuckle 11 is attached to the motor tilting bracket 18 preferably by means of a shackle 19 and eyebolt 20. Preferred attachment means is by a drilled hole in motor tilting bracket 18 and secured by nut 21.

Upon preliminary installation of the device to the existing outboard motor and outboard motor mounting apparatus (discussed as prior art) the motor is located into the approximate desired position and locked vertically by tightening two or more side bolts 22, 23 to prevent motor bracket 8 from dropping to bottom of travel. The cable 1, turnbuckle 11, shackle 19 are installed, the cable is passed through pulley 6 and attached to eyebolt 3 using thimble 4 and cable clamp 5. Excess cable slack can be removed with turnbuckle 11. At this point, side bolts 22, 23 may be loosened to allow cable to be loaded, by the weight of the engine. As the motor tilt/trim feature is utilized, the motor will raise and lower proportionally from hydraulic force by way of tilt cylinder 24. If a different range of motion within the limit of the slots 24 of the motor bracket 8 is desired, this may be accomplished through use of the turnbuckle 11. The recommended method for moving the range to a higher level in the slots is to position the motor at approximately half travel on the tilt/trim and tighten side bolts 22, 23. The motor tilt/trim may be lowered to slack the cable 1 at which point the turnbuckle may be tightened an appropriate amount. The side bolts are again loosened and the new range position is now established. The range may be moved to a lower position using similar steps, however, the turnbuckle is adjusted in the opposite direction as previously described.

Another useful feature of the invention is the ability to use the outboard motor mounting apparatus as a fixed mounting device with the invention providing the means for adjustment. This is accomplished by locating the motor angle member 8 in the desired position as described previously. With the side bolts 22, 23 tightened the motor tilt/trim may be lowered to slack the cable 1 at which point the turnbuckle 11 can be removed from the eyebolt 20 by opening the shackle. The removed cable assembly may then be attached to any fixed convenient location for later use. The motor angle member 8 and therefore the motor will remain at the desired fixed point regardless of the tilt/trim setting until another adjustment is made. This method of fixed adjustment accomplishes the same function as the conventional threaded bolt configuration, however offers the added convenience of adjustment from within the boat with no mechanical force required from the operator.

While a presently preferred embodiment of the present invention has now been described for the purpose of illustration, other mechanical assemblies that accomplish a likewise vertical movement of the motor bracket to the transom bracket such as linkages connecting to the motor tiling bracket 18 to a fixed part of the transom will be apparent to one skilled in this art which are within the scope and spirit of the invention.

What is claimed is:

1. An apparatus for utilizing the motion from arm outboard motor tilt/trim device to provide vertical movement to the outboard motor relative to the transom of the boat, said apparatus comprising:

cable means;

said cable means being connected on one end by means of a thimble and cable clamp to an eyebolt having means for connecting to the transom of a boat;

said cable means running downward from said eyebolt through a pulley;

said pulley having means for being affixed to a cross angle member of an outboard motor mounting bracket;

said cable means running upwardly from said pulley to a turnbuckle;

said turnbuckle being attached to the cable means by means of a compression wrap; and said turnbuckle being connected by means of an eyebolt to the outboard motor tilting bracket of the outboard motor mount;

whereby an outboard motor can be moved vertically relative to the transom of the boat to achieve maximum thrust.

* * * * *